US009835327B2

(12) United States Patent
Tomaselli et al.

(10) Patent No.: US 9,835,327 B2
(45) Date of Patent: Dec. 5, 2017

(54) GAS BURNER FOR COOKING APPLIANCES

(75) Inventors: Carlo Tomaselli, Pordenone (IT); Cedric Catalogne, Udine (IT); Francesco Corleoni, Forli (IT); Stefano Strada, Forli (IT); Marco Starnini, Forli (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 833 days.

(21) Appl. No.: 12/309,103

(22) PCT Filed: Aug. 2, 2007

(86) PCT No.: PCT/EP2007/058032

§ 371 (c)(1),
(2), (4) Date: May 7, 2009

(87) PCT Pub. No.: WO2008/028731

PCT Pub. Date: Mar. 13, 2008

(65) Prior Publication Data

US 2010/0000515 A1 Jan. 7, 2010

(30) Foreign Application Priority Data

Sep. 6, 2006 (EP) ..... 06120216

(51) Int. Cl.
*F24C 3/00* (2006.01)
*F23D 14/06* (2006.01)

(52) U.S. Cl.
CPC .... *F23D 14/06* (2013.01); *F23D 2900/00001* (2013.01)

(58) Field of Classification Search
USPC ..... 431/147, 268, 326, 329, 7, 354; 126/39 R, 39 E
See application file for complete search history.

(56) References Cited

U.S. PATENT DOCUMENTS 1,379,538 A 5/1921 Silva
1,895,032 A * 1/1933 Fisher ..... 44/353
(Continued)

FOREIGN PATENT DOCUMENTS

DE 19724810 A1 * 12/1997 ..... F23D 14/02
DE 19724812 A1 * 12/1997
(Continued)

OTHER PUBLICATIONS

International Search Report dated Feb. 27, 2008 for International Application No. PCT/EP2007/058032.
(Continued)

*Primary Examiner* — Avinash Savani
*Assistant Examiner* — Vivek Shirsat
(74) *Attorney, Agent, or Firm* — Pearne & Gordon LLP

(57) ABSTRACT

The invention relates to a burner for gas-fired cooking appliances, with a structure comprised of: a body (10) defining a chamber (12) within which an injector (14) inputs the gas which, upon mixing with air, forms the gas-air combustible mixture; a ring (16) positioned over the body and provided with a periphery along which are arranged the combustible mixture outlet ports (18), and a circular plate (20) that closes the top of the burner. At least the burner ring (16) is made of a metal or a metal alloy and is coated with a thin layer of material having catalytic activity, which may be coated on a catalyst precursor porous support substrate.

26 Claims, 4 Drawing Sheets

(56) References Cited

U.S. PATENT DOCUMENTS

| | | | | | |
|---|---|---|---|---|---|
| 2,044,511 | A | * | 6/1936 | Ryschkewitsch | 431/347 |
| 3,088,271 | A | * | 5/1963 | Smith | 422/177 |
| 3,473,987 | A | * | 10/1969 | Sowards | 156/89.22 |
| 3,538,908 | A | * | 11/1970 | Reid et al. | 126/39 J |
| 3,817,689 | A | * | 6/1974 | Capy | 431/349 |
| 3,885,020 | A | * | 5/1975 | Whelan | 423/245.3 |
| 3,921,913 | A | | 11/1975 | Capy | |
| 3,955,556 | A | * | 5/1976 | Pangborn et al. | 122/18.1 |
| 4,008,037 | A | * | 2/1977 | Hindin et al. | 431/2 |
| 4,018,553 | A | * | 4/1977 | Baker et al. | 431/7 |
| 4,080,150 | A | * | 3/1978 | Hunter et al. | 431/6 |
| 4,154,568 | A | * | 5/1979 | Kendall et al. | 431/7 |
| 4,270,896 | A | * | 6/1981 | Polinski et al. | 431/328 |
| 4,421,476 | A | * | 12/1983 | Gulden et al. | 431/243 |
| 4,588,373 | A | * | 5/1986 | Tonon et al. | 431/328 |
| 4,870,824 | A | * | 10/1989 | Young et al. | 60/723 |
| 4,917,599 | A | * | 4/1990 | Hasselmann | 431/328 |
| 5,169,300 | A | * | 12/1992 | Chou et al. | 431/7 |
| 5,183,401 | A | * | 2/1993 | Betta et al. | 431/7 |
| 5,328,357 | A | * | 7/1994 | Riehl | F23D 14/06 126/39 E |
| 5,352,114 | A | * | 10/1994 | Numoto et al. | 431/7 |
| 5,405,260 | A | * | 4/1995 | Betta et al. | 431/7 |
| 5,511,972 | A | * | 4/1996 | Betta et al. | 431/170 |
| 5,518,697 | A | * | 5/1996 | Betta et al. | 422/173 |
| 5,746,194 | A | * | 5/1998 | Legutko | 126/91 A |
| 5,810,577 | A | * | 9/1998 | Ledjeff | 431/170 |
| 6,015,285 | A | * | 1/2000 | McCarty et al. | 431/7 |
| 6,145,501 | A | * | 11/2000 | Manohar | F23C 13/00 126/110 R |
| 6,231,991 | B1 | * | 5/2001 | Maloney | 428/469 |
| 6,537,065 | B1 | * | 3/2003 | Shirali et al. | 431/354 |
| 6,638,055 | B2 | * | 10/2003 | Carroni et al. | 431/9 |
| 6,736,634 | B2 | * | 5/2004 | Manohar et al. | 431/328 |
| 7,040,890 | B2 | * | 5/2006 | Todoli et al. | 431/266 |
| 7,241,137 | B2 | * | 7/2007 | Leinemann et al. | 431/346 |
| 7,541,005 | B2 | * | 6/2009 | Kulkarni et al. | 422/177 |
| 2003/0031972 | A1 | * | 2/2003 | Griffin et al. | 431/354 |
| 2003/0186181 | A1 | * | 10/2003 | Kang et al. | 431/7 |
| 2005/0112520 | A1 | | 5/2005 | Todoli et al. | |
| 2006/0141412 | A1 | * | 6/2006 | Masten et al. | 431/326 |
| 2006/0141413 | A1 | * | 6/2006 | Masten et al. | 431/328 |
| 2006/0196493 | A1 | * | 9/2006 | Serenellini | 126/39 E |

FOREIGN PATENT DOCUMENTS

| | | | | | |
|---|---|---|---|---|---|
| DE | 19724813 | A1 | * | 12/1997 | F23D 14/18 |
| EP | 1 512 909 | | | 3/2005 | |
| GB | 2 347 362 | | | 9/2000 | |
| GB | 2347362 | A | * | 9/2000 | F23D 14/18 |
| JP | 55031257 | A | * | 3/1980 | F23N 5/24 |
| JP | 56042003 | A | * | 4/1981 | F23C 11/00 |
| JP | 57028907 | A | * | 2/1982 | F23D 13/14 |
| JP | 57087517 | A | * | 6/1982 | F23D 13/10 |
| JP | 60026211 | A | * | 2/1985 | F23D 14/14 |
| JP | 60060411 | A | * | 4/1985 | F23D 14/18 |
| JP | 61140715 | A | * | 6/1986 | F23D 14/18 |
| JP | 02213607 | A | * | 8/1990 | F23D 14/18 |
| JP | 7-91622 | | | 4/1995 | |
| JP | 07091622 | A | * | 4/1995 | F23D 14/68 |

OTHER PUBLICATIONS

Written Opinion of the International Searching Authority dated Feb. 27, 2008 for International Application No. PCT/EP2007/058032.

* cited by examiner

GAS BURNER FOR COOKING APPLIANCES

BACKGROUND OF THE INVENTION

(1) Field of the Invention

The present invention relates to gas-fired cooking appliances, in particular of household type, and regards specifically the burners for such appliances.

(2) Description of Related Art

As is well known, the combustion process that takes place in these appliances generates various noxious substances, such as nitrogen oxides (NOx), volatile organic compounds (VOC) and carbon oxides (CO and CO2).

The problem of eliminating or reducing these substances to improve the working conditions in cooking environments has been tackled for a long time with various technical solutions.

One of the known solutions provides for the use of so-called "catalytic" burners, i.e., burners in which a gas-air mixture is passed through a structure constructed or coated with a material that produces a flame-less combustion of the mixture. These burners act substantially as filters designed to absorb the combustion gases or produce an exothermic oxidation of the same, so as to eliminate the noxious substances resulting from combustion.

GB 2,347,362 discloses a burner of this type, with a structure made of ceramic material, such as cordierite, and the catalyst includes at least one metal selected from among platinum, rhodium, palladium and iridium, with the preferred metal being platinum. Cordierite is chosen because it displays a surface porosity necessary to achieve the deposition of the catalyst, thus increasing the active surface in the elimination of noxious gases. However, the construction of catalytic burners with a structure of ceramic material has not proved to be advantageous in household applications for various reasons, such as, for example, the fragility of the material, which is scarcely suitable for an object, such as a burner, consisting of a plurality of pieces which need to be frequently disassembled for cleaning and maintenance. In addition, the catalytic material is applied to only one part of the surface of the burner, particularly on the outlet surface of the structure, as it is believed it should act on the gaseous products of combustion, that is, after the combustion has occurred.

A similar solution is disclosed in JP 07091622, where the surfaces that come into contact with gas emissions are coated with catalyzing material to produce an oxidation-reduction of the same emissions.

The known catalytic burners act by eliminating the noxious substances produced by combustion because, as already mentioned, the catalyst is made to act downstream of combustion. Thus, the main advantage obtainable with the use of catalytic burners has been to facilitate the maintenance of the cleanness of the surfaces in contact with the flame, with the so-called self-cleaning burners. Examples of catalytic burners of this type are described in U.S. Pat. No. 3,817,689 and U.S. Pat. No. 3,921,913.

BRIEF SUMMARY OF THE INVENTION

The main objective of this invention is to provide a burner for cooking appliances, particularly of household type, that effectively resolves the problem of eliminating the noxious products of combustion, by bringing the air-gas mixture in contact with a catalytic surface before combustion takes place.

Another objective of the invention is to provide a burner of catalytic type that offers a greater thermal efficiency and reduces the energy required for combustion.

A further objective of the invention is to provide a burner of catalytic type whose structure is realized with metal materials suitable for use in household cooking appliances, particularly aluminium alloys, which ensure the required mechanical sturdiness.

These and other objectives of the invention will be achieved with a burner as described hereunder and with specific reference to the appended claims.

BRIEF DESCRIPTION OF THE DRAWINGS

The characteristics and advantages of the present invention will become clear from the following description, given by way of example and not by way of limitation, with reference to the accompanying drawings, wherein.

Figure 1:
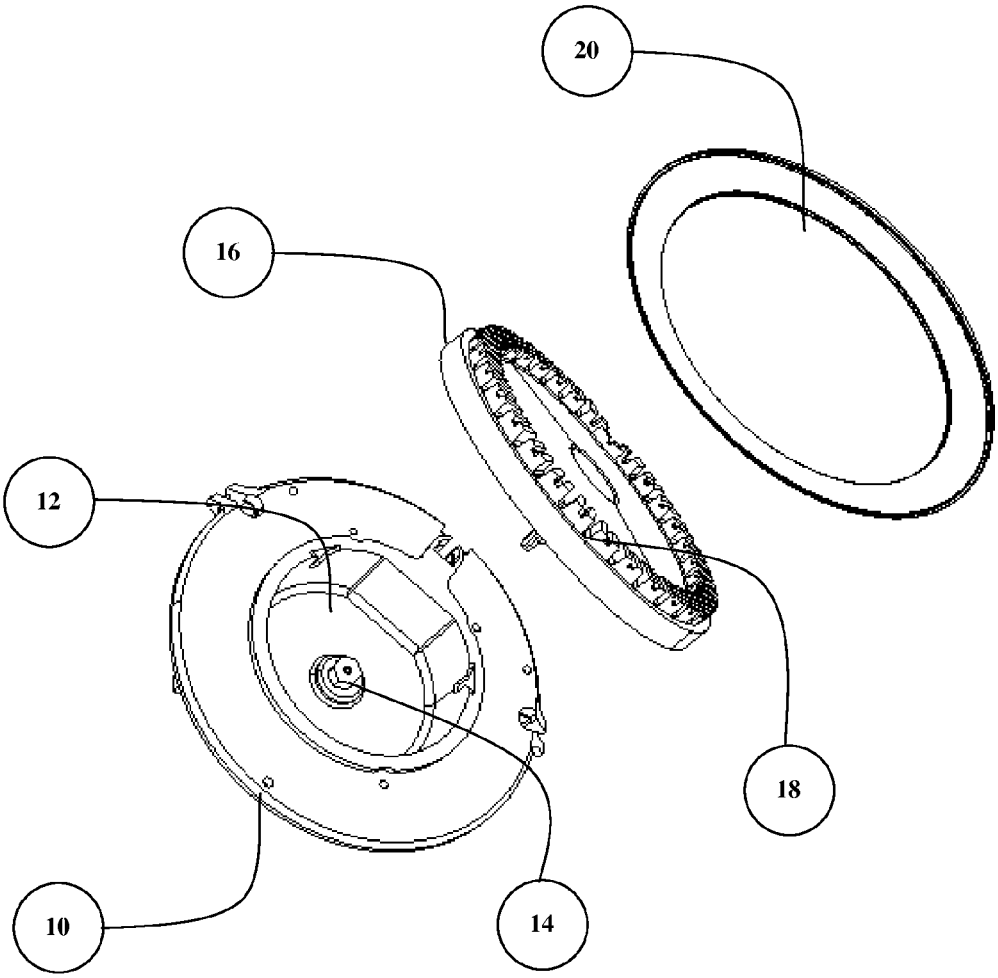
FIG. 1 is an exploded perspective view of a burner structure according to the invention.

A burner according to the invention has a structure (FIG. 1) that substantially consists of: a body 10 defining a chamber 12, wherein an injector 14 inputs the gas that upon mixing with the air forms the combustible air-gas mixture; a ring-shaped element 16 on the upper side of the body, having a periphery provided with the combustion mixture outlet ports 18, and a burner-covering circular plate 20.

According to the invention, at least the ring-shaped element 16 is made of a metal or metal alloy, preferably an aluminium alloy such as Pyral (96% Al, 2% Mg, 2% Si), a material widely used in the production of gas-fired burners. Naturally, the body 10 and the circular plate can also be made from metal material or a metal alloy.

As is well known, the combustible mixture issues from the outlet ports 18 and is ignited by an ignition device (non shown), forming a crown of flames around the periphery of the burner. The heat generated by combustion is transmitted to the whole structure of the burner, which reaches a high steady-state temperature (in the order of several hundred degrees Celsius).

Figure 2:
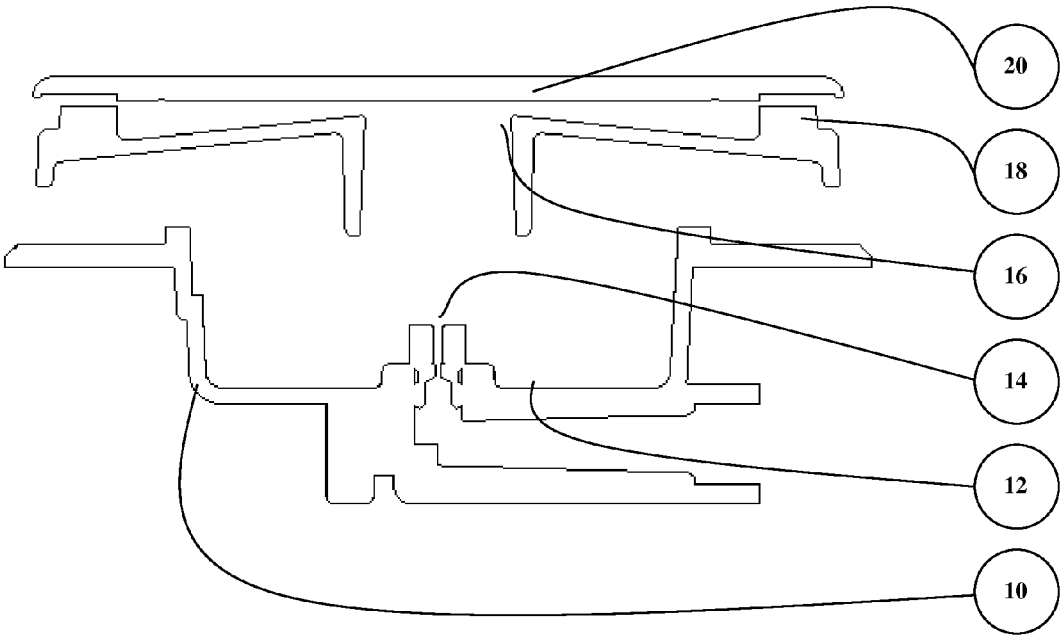
FIG. 2 is a schematic cross section of the burner structure of FIG. 1.

According to the invention, at least the ring 16 (FIG. 2) is coated with a thin layer of material having a catalytic activity, for the purpose of reacting with the gas-air mixture that flows out along the surface of the ring.

Figure 5A:
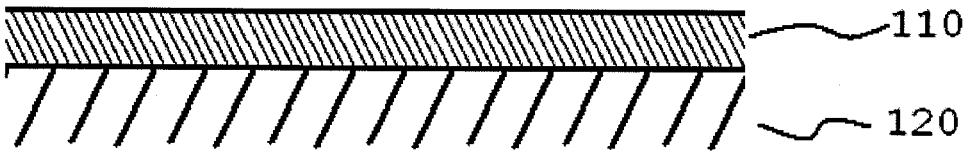
FIGS. 5A and 5B each show a cross sectional view of a surface of the burner.
Figure 5B:
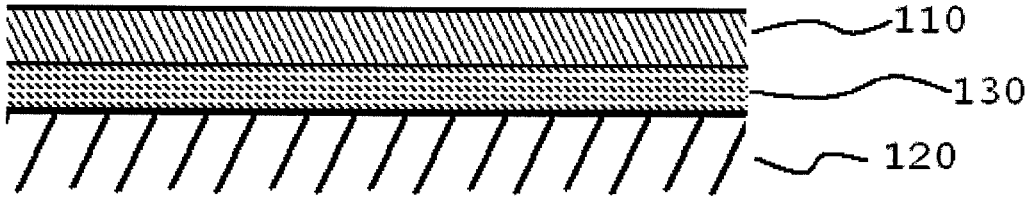

As shown in FIG. 5A, the thin layer of material 110 having catalytic activity is formed on a surface 120 of the burner. This surface 120 may be at least an underside surface of the burner-covering plate. As mentioned above, this surface 120 may also be on the ring 16. This surface may also be at least an internal surface of the burner body 10. As shown in FIG. 5B, a support layer 130 may be formed on the surface 120. The layer 130 may also be a buffer layer or substrate.

The coating material having catalytic activity is made up of metal oxides, either simple or mixed, in particular oxides of alkaline or alkaline-earth metals, that are coated on the burner surfaces by means of known procedures, for example by immersion in a catalyst bath.

To obtain a suitable coating, the surfaces can be, if necessary, prepared by forming on them the support layer 130 that serves as suitable precursor of the catalyst. When the burner is made of Pyral, which has a compact surface with low porosity, the surfaces can be prepared by coating them with an alumina layer AI2O3, for example by electrochemical oxidation, so as to form a buffer layer or substrate.

The catalysts used, which are active at the typical temperatures of household gas burners (200-4000 C), enable the gas-air combustible mixture to burn with a better combustion, reducing the production of noxious gases, while lowering the quantity of energy required for combustion, with the result of improving its efficiency and consequently reducing the output of noxious gases. In fact, the contact of the combustible mixture with the catalyst-coated and activated burner surfaces has the effect of preoxidizing the air-gas mixture within the burner body.

The combustion reaction requires considerable quantity of activation energy. This activation energy is considerably reduced in a burner coated with catalyzing material according to the invention.

Figure 3:
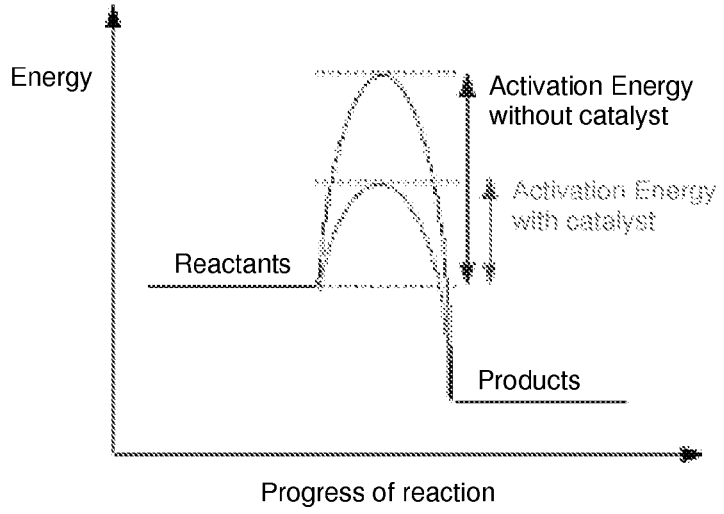
FIG. 3 is a diagram illustrating the energy required to activate the catalytic reaction in the combustion process.

As shown in the diagram of FIG. 3, the use of the catalyst makes it possible to lower the priming energy necessary to activate the combustion process.

Figure 4:
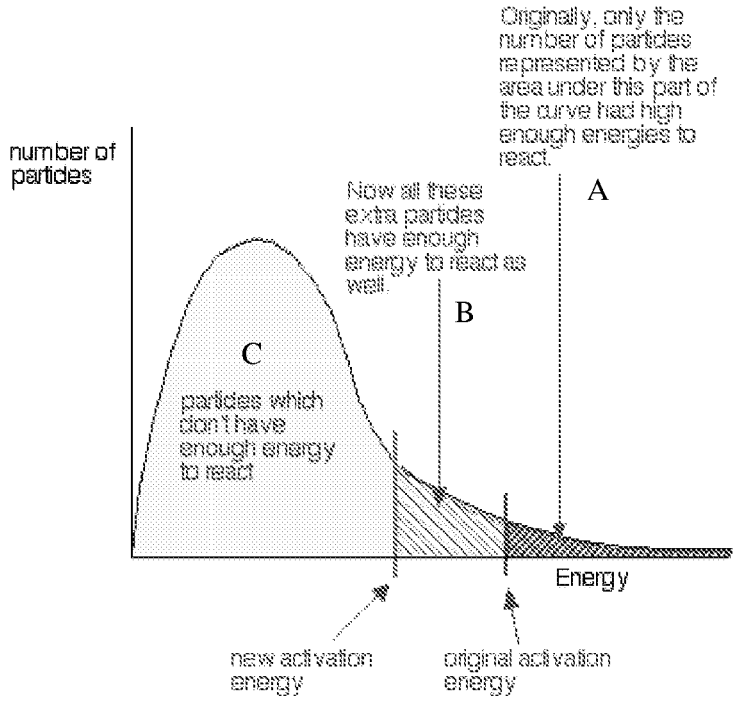
FIG. 4 is a diagram showing the quantities of catalyst that are activated to generate combustion as a function of the energy supplied.

The reduction of the combustion activation energy is due to the fact that the catalytic reaction brings about an increase in the quantity of fuel particles that acquire the energy necessary for combustion. Normally, the quantity of particles provided with such energy is represented by area A in the diagram of FIG. 4, while area B represents the additional quantity of particles that are activated by the catalytic reaction to generate combustion. Finally, area C represents the quantity of particles that do not have sufficient energy to take part in the reaction.

The invention claimed is:

1. A burner for gas-fired cooking appliances, the burner comprising:

a burner body defining a chamber;

a burner-covering plate positioned above the burner body;

a ring-shaped burner element positioned between the burner body and the burner-covering plate, the ring-shaped burner element and the burner-covering plate defining an outlet between a periphery of the ring-shaped burner element and a periphery of the burner body; and an injector for introducing gas into the chamber of the burner body wherein the flow of gas from the injector draws air into the chamber from a surrounding environment from an air inlet to form a combustible gas-air mixture within the chamber, the combustible gas-air mixture being conveyed into a space defined between the ring-shaped burner element and the burner-covering plate;

wherein at least the ring-shaped burner element is made of a metal or a metal alloy and is coated with a thin layer of material having catalytic activity, wherein the ring-shaped burner is configured such that the combustible gas-air mixture is conveyed over the material having catalytic activity and reacts with the material having catalytic activity upstream of the outlet to form a pre-oxidized air-gas mixture within the chamber of the burner body, the outlet between the periphery of the ring-shaped burner element and the periphery of the burner body configured to allow the pre-oxidized air-gas mixture to exit the chamber of the burner body for ignition outside of the chamber, and wherein the material having catalytic activity is one of simple metal oxides and mixed metal oxides.

2. The burner of claim 1, wherein the material having catalytic activity is one of oxides of alkaline and oxides of alkaline-earth metals.

3. The burner of claim 1, wherein the burner-covering plate is made of a metal or metal alloy, and at least an underside surface of the burner-covering plate is coated with a thin layer of the material having catalytic activity.

4. The burner of claim 3, wherein the material having catalytic activity is one of oxides of alkaline and oxides of alkaline-earth metals.

5. The burner of claim 1, wherein the burner body is made of a metal or metal alloy and at least an internal surface of the burner body is coated with a thin layer of the material having catalytic activity.

6. The burner of claim 5, wherein the material having catalytic activity is one of oxides of alkaline and oxides of alkaline-earth metals.

7. The burner of claim 1, wherein the burner is made of aluminum alloy.

8. The burner of claim 1, wherein the burner is made of Pyral.

9. The burner of claim 1, wherein the thin layer of material having catalytic activity is formed by immersion in a catalyst bath.

10. A burner for gas-fired cooking appliances, the burner comprising:

a burner body defining a chamber a burner-covering plate positioned above the burner body;

a ring-shaped burner element positioned between the burner body and the burner-covering plate, the ring-shaped burner element and the burner-covering plate defining an outlet between a periphery of the ring-shaped burner element and a periphery of the burner body; and an injector for introducing gas into the chamber of the burner body wherein the flow of gas from the injector draws air into the chamber from a surrounding environment through an air inlet to form a combustible gas-air mixture within the chamber, the combustible gas-air mixture being conveyed into a space defined between the ring-shaped burner element and the burner-covering plate;

wherein at least the ring-shaped burner element is made of a metal or a metal alloy and is coated with a thin layer of material having catalytic activity, wherein the burner-covering plate is made of a metal or metal alloy, and at least an underside surface of the burner-covering plate is coated with a thin layer of material having catalytic activity, wherein the ring-shaped burner is configured such that the combustible gas-air mixture is conveyed along the underside surface of the burner-covering plate and along a surface of the ring-shaped burner element and reacts with the materials having catalytic activity upstream of the outlet to form a pre-oxidized air-gas mixture in the chamber of the burner body, the outlet between the periphery of the ring-shaped burner element and the periphery of the burner body configured to allow the pre-oxidize air-gas mixture to exit the chamber of the burner body for ignition outside of the chamber, and wherein the thin layer of material having catalytic activity on the ring-shaped burner element and the underside surface of the burner-covering plate is one of simple metal oxides and mixed metal oxides.

11. The burner of claim 10, wherein the material having catalytic activity is one of oxides of alkaline and oxides of alkaline-earth metals.

12. The burner of claim 11, wherein the burner body is made of a metal or metal alloy and at least an internal surface of the burner body is coated with a thin layer of the material having catalytic activity.

13. The burner of claim 10, wherein the burner is made of aluminum alloy.

14. The burner of claim 10, wherein the burner is made of Pyral.

15. The burner of claim 10, wherein the thin layer of material having catalytic activity is formed by immersion in a catalyst bath.

16. The burner of claim 10, wherein the ring-shaped burner is configured such that the combustible gas-air mixture reacts with the material having catalytic activity on the bottom surface of the ring-shaped burner before the combustible gas-air mixture is combusted by flowing outwardly along the bottom surface of the ring-shaped burner.

17. The burner of claim 8, wherein a buffer layer of $Al_2O_3$ is disposed on the ring-shaped burner element and between the ring-shaped burner element and the material having catalytic active.

18. The burner of claim 1, wherein a buffer layer of $Al_2O_3$ is disposed on the ring-shaped burner element and between the ring-shaped burner element and the material having catalytic active.

19. The burner of claim 1, wherein the air inlet to the chamber is on a periphery of the burner body.

20. The burner of claim 10, wherein the air inlet to the chamber is on a periphery of the burner body.

21. The burner of claim 1, further comprising an ignition device for igniting the pre-oxidized air-gas mixture outside the chamber of the burner body.

22. The burner of claim 10, further comprising an ignition device for igniting the pre-oxidized air-gas mixture outside the chamber of the burner body.

23. The burner of claim 1, wherein at least one of the ring-shaped burner element and the burner-covering plate includes a plurality of tooth-shaped projections disposed on a peripheral edge of the at least one of the ring-shaped burner element and the burner-covering plate.

24. The burner of claim 10, wherein at least one of the ring-shaped burner element and the burner-covering plate includes a plurality of tooth-shaped projections disposed on a peripheral edge of the at least one of the ring-shaped burner element and the burner-covering plate.

25. The burner of claim 1, wherein the material having catalytic activity has an activation temperature in the range of 200-400° C.

26. The burner of claim 10, wherein the material having catalytic activity has an activation temperature in the range of 200-400° C.

* * * * *